US007237700B2

(12) United States Patent
Bulovic

(10) Patent No.: US 7,237,700 B2
(45) Date of Patent: Jul. 3, 2007

(54) HANGERS FOR CLOTHING AND OTHER ITEMS

(76) Inventor: Bozdar Bulovic, 24 Regent Dr., Oak Brook, IL (US) 60523

( * ) Notice: Subject to any disclaimer, the term of this patent is extended or adjusted under 35 U.S.C. 154(b) by 416 days.

(21) Appl. No.: 10/820,849

(22) Filed: Apr. 9, 2004

(65) Prior Publication Data

US 2005/0224531 A1 Oct. 13, 2005

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 4,557,407 A * 12/1985 Bogaczyk ..... 223/96
6,021,934 A * 2/2000 Ho ..... 223/98
6,155,467 A * 12/2000 Chen ..... 223/85
6,264,076 B1 * 7/2001 Stocchiero ..... 223/85
6,467,659 B2 * 10/2002 Gouldson ..... 223/96

* cited by examiner

*Primary Examiner*—Shaun R. Hurley
(74) *Attorney, Agent, or Firm*—Penrose Lucas Albrigh

(57) ABSTRACT

A mechanism for hanging garments and other items which comprises a plurality of substantially horizontally disposed rods which define between them slots for removably receiving clothing articles and the like. Each slot has extending therefrom a plurality of fibers which are connected to the rod to extend at an upward inclination and are arcuately moveable relative thereto. When garments or other articles are moved horizontally into slots the fibers resiliently curve downwardly to clamp the garments or other articles against the opposite side of the slot from which they extend in a cam-like fashion. The mechanism may include a plurality of slots arranged in a line or at different levels so that garments in the upper level hang between garments in the lower level. A plurality of mechanisms may be disposed parallel in arrays or mounted on rotatable stands.

25 Claims, 12 Drawing Sheets

HANGERS FOR CLOTHING AND OTHER ITEMS

FIELD OF THE INVENTION

This invention relates to a clothes hanger and more particularly to a novel means for securing the garments to a clothes hanger. It also relates to using the same novel means for securing other items in a simple and relatively quick fashion.

BACKGROUND OF THE INVENTION

There are numerous types of hangers for clothing. The most commonly known and used is probably a wire hanger which is configured as a more or less squat isosceles triangle that at its upper apex has a hook formed from twisting together wires which meet where the two equal inclined sides of the triangle join. Similarly configured hangers composed of wood or plastic are also quite common. The problem with hangers of this nature is that the trousers or slacks or skirts which they support need to be folded over the lower long or horizontal side of the hanger which can be not only comparatively time consuming but also may cause an unwanted crease in the garment at the fold.

Another common hanger for trousers and slacks comprises a pair of horizontal clamp parts which are resiliently urged together to clamp the trousers or slacks at their cuffs. A hook is provided that extends above the clamping parts which, in turn, is received by a bar or rod that extends horizontally in a closet or the like. These hangers avoid imparting an unwanted crease to the trousers or slacks. But they are somewhat difficult to manipulate both in maneuvering the cuffs of the trousers or slacks between the clamping parts and in the subsequent unclamping action to remove them when desired.

Another type of hanger which is used primarily by women to hang slacks or skirts is similar in configuration to the first mentioned hanger described above except that a portion of the lower horizontal part of the isosceles triangle may be removed and a pair of resilient clamps are provided on the remaining horizontal portions near the outboard ends of the hanger. In a variation, the clamps may be slidable along a horizontal rod. These clamps are, if anything, even more difficult to operate for clamping the garment in place than required for the second hanger mentioned above.

Other combinations exist such as a combination of clamping means together with slanting arms disposed above the clamping means which are configured for receiving coats, shirts, sweaters, and the like. But they all suffer from drawbacks because they are, from a comparative standpoint, time consuming to use and, moreover, when clamps are involved, people with disabilities such as arthritis of the hands and wrists find them difficult and sometimes practically impossible to manipulate.

An important object of the present invention is to provide a clothing hanger wherein clothing, particularly garments such as trousers, slacks and skirts can be quickly, safely and securely received by that hanger and then again quickly, safely and securely removed therefrom even by persons who suffer substantially from disabilities of their hands, wrists or arms.

SUMMARY OF THE INVENTION

It has occurred to the inventor that a plurality of a flexible hanging or holding elements, preferably fibers, can be disposed in a slot for receiving the garments wherein these elements provide minimal resistance to a garment being slid into the slot and the same elements prevent the garment from falling from the slot or, in other words, garments are retained in and hang from the slots until they are ready to be removed which is accomplished surprisingly easily and quickly, again even by persons having substantial disabilities of their hands, wrists or arms, while avoiding difficulties incident to clamping types of hangers or the need to manipulate and fold the garment over a horizontal bar. In this connection, the inventor has discovered that brush type fibers secured on one side and extending with an upward inclination across the opening of a horizontal slot provide minimal resistance to moving a garment into the receiving slot and then, when the garment is received in the slot, they retain same in place with a cam-like action until the garment is removed by simply moving the garment sideways from the slot against the minimal resistance provided by the brush fibers.

Although other retaining elements may be used for the same purpose, fibers such as those used in brushes seem to work best in that they provide minimal resistance to horizontal movement of the garment into and from the slots and, at the same time, provide sufficient friction by a cam-like motion to prevent the garments from falling vertically from the slots. Also, as a practical matter, brush fibers are readily available, inexpensive and long lasting.

The inventor's clothes hanger is relatively inexpensive while operating more efficiently and effectively than prior art hangers. It is comparatively easy to manufacture, requires almost no maintenance and can be depended upon to operate usefully over many years. It saves users' time and effort in hanging and removing garments from hangers and is adapted to be used as a space saver for hanging garments. It is particularly advantageous for disabled people. All in all, it is submitted that the invention improves the quality life of users and does so in a manner which is both unique and novel. In addition, the same concept may be usefully applied for hanging other articles such as towels and other items wherein ease of insertion and removal are advantageous.

BRIEF DESCRIPTION OF THE DRAWINGS

Other objects, adaptabilities and capabilities will appear as the description progresses, reference being had to the accompanying drawings, in which:

FIG. 11 is a side elevational view, similar to FIG. 4, of another embodiment which shows the holding member of the invention in combination with an upper hanger part for receiving coats, sweaters, shirts or the like;

FIG. 26 is a further broken isometric view which illustrates a fork in accordance with the invention which is removably supported on a bar which may be mounted in a closet or the like.

DETAILED DESCRIPTION OF THE PREFERRED EMBODIMENTS OF THE INVENTION

Figure 1:
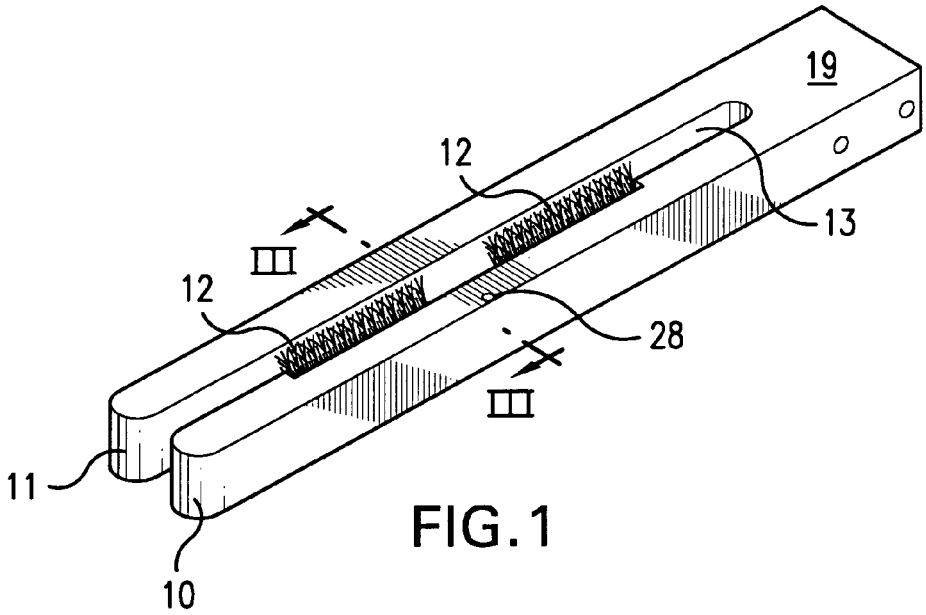
FIG. 1 is an isometric view of a fork assembly in accordance with the invention.
Figure 2:
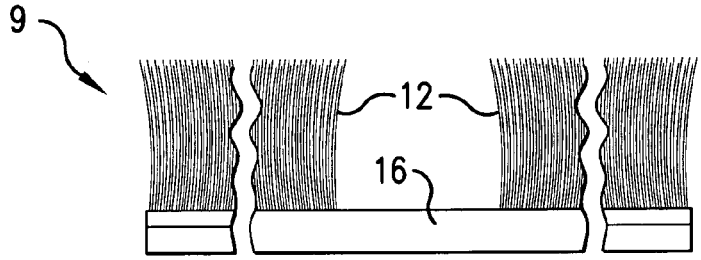
FIG. 2 is a detailed broken view of a brush cam which is included in the assembly shown in FIG. 1.
Figure 3:
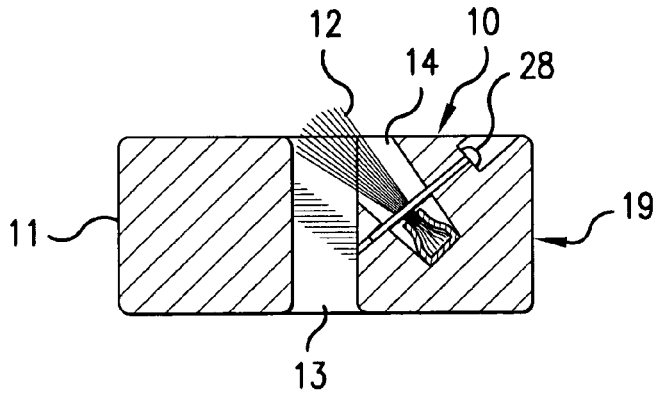
FIG. 3 is a cross-sectional view taken on Section line III—III in FIG. 1.

The basic fork assembly 19 which is illustrated in FIGS. 1, 2 and 3 is substantially the same as the fork disclosed in the remaining embodiments which have, however, variations that will be appreciated from their descriptions. Fork 19 thus comprises a brush holder bar 10 and a passive support bar 11 with slot 13 is provided between bars 10 and 11. A groove 14 in bar 10 receives a brush assembly 9. As seen in FIG. 2, brush assembly 9 includes two brushes 12 and a brush retainer 15 which holds brushes 12 in a spaced apart disposition. As seen in FIG. 3, a pin 28 is received in bar 10 at an angle between brushes 12 to retain brush assembly 9 in place. As retained by pin 28 in groove 14, brushes 12 extend upwardly at an angle 45 degrees and are movable together within an arc of 15 degrees, that is, their arc of movement is from 45 to 60 degrees relative to the horizontal. As shown in FIG. 3, brushes 12 extend outwardly almost to the interior side of rod 11 but are spaced a very small distance therefrom. The embodiment disclosed in FIGS. 1, 2 and 3 is to scale as are generally all the other figures in this Application. Fork 19 has a width of 2 3/16 ths inches and slot 13 has a width of 3/8 ths of an inch. Groove 14 is 7 1/4 th inches long with brush cam 9 having a length of 7 3/16 ths inches. The vertical dimension of rods 10 and 11 is 1 1/8 th inches and the horizontal width of each is 29/32 nds. Brushes 12 comprise soft polypropylene bristles. Fork 19 as disclosed in FIGS. 1, 2 and 3 is the result of considerable trial and error and although it is contemplated that modifications may be made without departing from the scope of the invention, it is considered that the description of fork 19 shown in FIGS. 1, 2 and 3, and of the invention as further described should enable any person skilled in the art to which the invention pertains or with which it is most nearly connected to practice the invention with little, if any, further experimentation.

Figure 4:
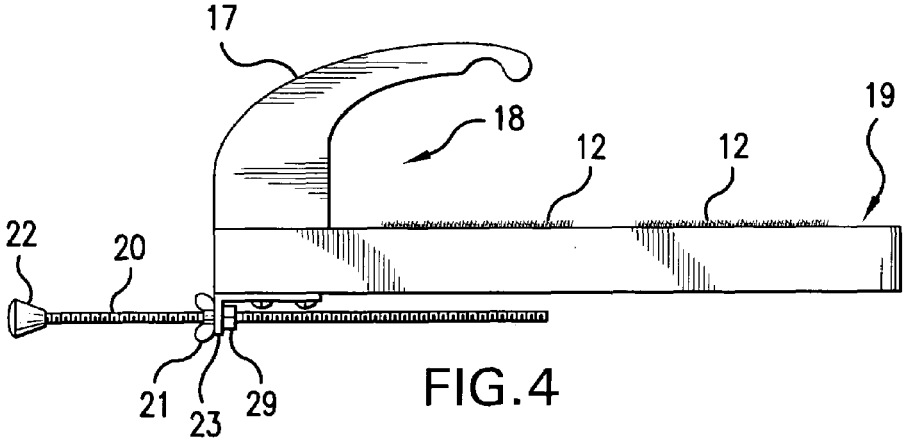
FIG. 4 is a side elevational view of a hanger in accordance with the invention.
Figure 5:
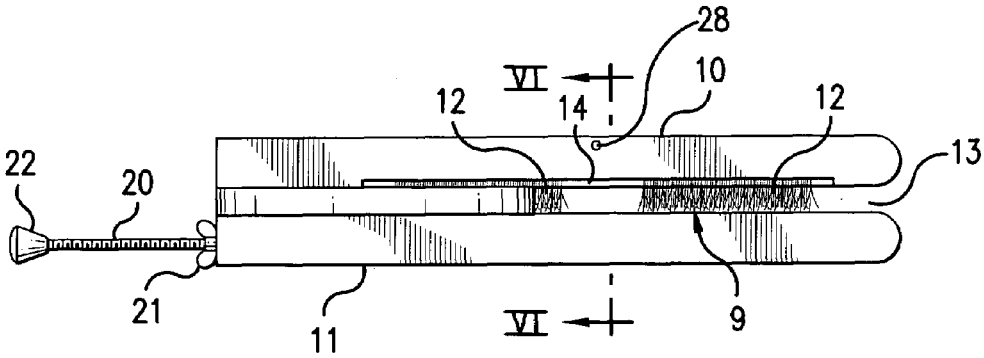
FIG. 5 is a top plan view of the invention shown in FIG. 1.
Figure 6:
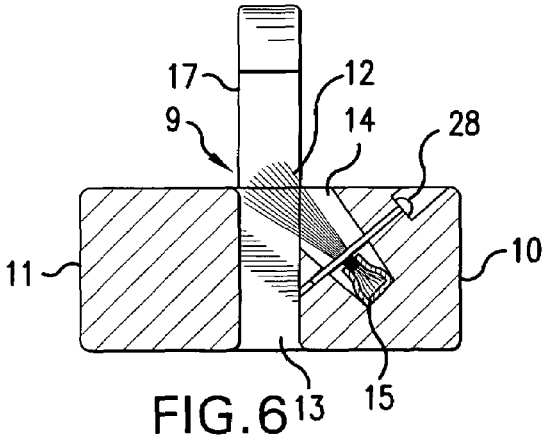
FIG. 6 is a cross-sectional view taking on section lines VI—VI of FIG. 5 which shows the resilient holding means in a slot for receiving garments before a garment is received therein.
Figure 7:
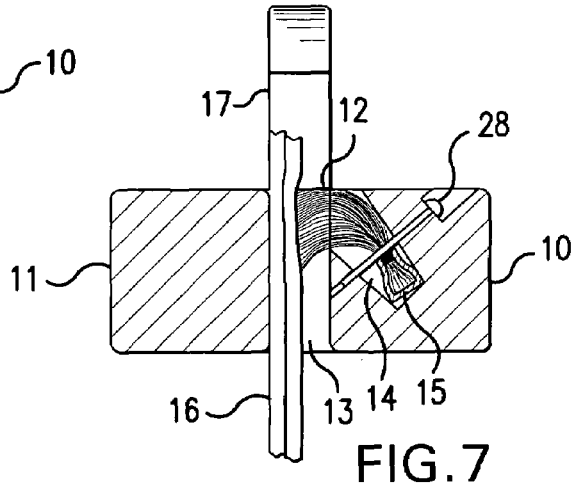
FIG. 7 is a sectional view similar to FIG. 6 showing, however, a garment being held by the resilient holding means in a slot.

Referring to FIGS. 4 and 5, a hanger in accordance with the invention which is designated generally by reference numeral 18 is shown. Hanger 18 has a garment receiving fork 19 which, as described for FIGS. 1, 2 and 3, comprises a brush holder support bar 10 that together with a passive support bar 11 define between them a slot 13. Brush holder support bar 10 has formed therein a brush holder groove 14 wherein resilient holding means 9 is secured that, in this case, comprising two brushes 12. It will be noted that brushes 12 extend outwardly with an upward inclination from a brush retainer 15 and are capable of arcuate movement in slot 13 as may be seen in FIG. 7 wherein a brush 12 is shown curved downwardly after a garment comprising trousers 16 has been inserted into slot 13. Such trousers 16 were first moved horizontally into slot 13 wherein they encountered very little resistance from the fibers of brushes 12. Preferably, but not necessarily, trousers 16 are bent somewhat to the right whereupon they lower slightly and assume a position wherein the ends of the brush fibers together with the inside surface of passive support bar 11 frictionally retain the garment in slot 13. When trousers 16 are to be removed from slot 13 they are simply withdrawn sidewise therefrom. The fibers bend outwardly towards the opening of slot 13 and provide minimal resistance to a garment's removal from slot 13. This resistance is comparatively minor as compared to the combined frictional resistance which brush fibers 12 and the inside of bar 11 provide to retain trousers 16 in slot 13 against the forces of gravity.

A rod or pin 28 may be provided which is inclined downwardly relative to slot 13 between brushes 12 to ensure that they are retained, albeit arcuately movably, in grooves 14 as desired.

If desired, rod 11 may be a mirror image of rod 10 whereby brushes 12 extend upwardly towards to a small distance from each other into slot 13.

As seen in FIGS. 4, 5, 6 and 7, a hanger hook member 17 is rigidly secured at one end of fork 19 to and between bars 10 and 111 which retains them in their parallel horizontal positions and defines the width of slot 13. A wall engaging member 20, which is an elongated threaded member, is fastened to bar 11 immediately thereunder and parallel thereto which has a buffer cap 22 at its end. A plastic nut 21 is provided which limits, when the invention is installed in a closet, undesired movement of wall engaging member 20 and provides that member 20 can be adjusted so that buffer cap 22 is received against closet wall or a board secured to the wall whereby the invention is retained substantially horizontally and prevented from slipping off of a hanger rod. Rods 10 and 11 may then be inclined slightly upwardly from the closet wall whereby rods 10 and 11 are retained more or less in the same substantially horizontal position irrespective of the weight or lack thereof of trousers 16 or other garments in slot 13. An angle piece 23 secured to the bottom of bar 11 is provided with a threaded bore which threadably receives member 20 whereby it extends from piece 23 as required for cap 22 to abut against the closet wall or a board secured thereto. Alternatively, a wall engaging member groove may be provided in the bottom of rod 11 to provide ample room for adjustment of member 20, depending upon how far the wall is from the hanger rod in a closet without having the problem of drilling a lengthy longitudinal bore through rod 11.

Figure 8:
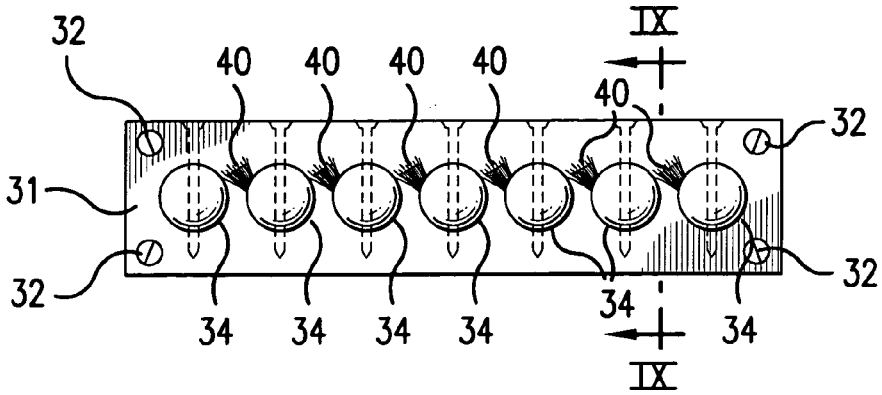
FIG. 8 is an elevational view of a plurality of hangers in accordance with the invention mounted on a supporting plate for being fastened to the wall of a closet.
Figure 9:
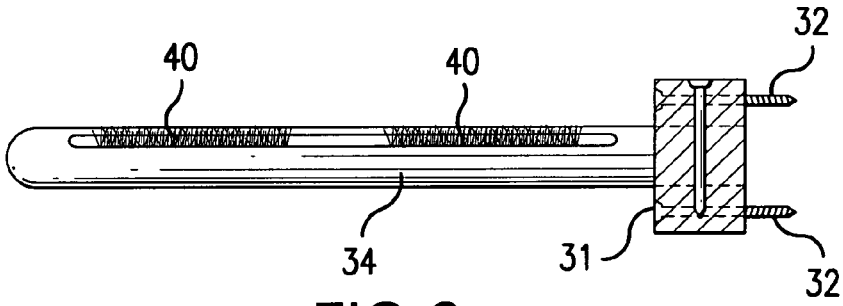
FIG. 9 is a cross-sectional view taken on section lines IX—IX of FIG. 8.

FIGS. 8 and 9 illustrate a plurality of hangers in accordance with the invention which can be mounted directly to a closet wall or a board attached thereto. Also it will be appreciated that a plurality of hangers in accordance with the invention may be mounted on a framework which is installed in a closet for the purposes of efficiency and to provide a capacity to rearrange a closet or to place the invention within a closet at a selected location. In FIG. 8, a plurality of combined brush holding and passive cylindrical rods 34 are shown. Thus, each rod 34 is used to perform the functions of both rods 10 and 11 as heretofore shown. It will be appreciated that rods 34 each have resilient holding fiber elements 40 which preferably comprise brushes 40 which are the same or similar to brushes 12 shown in FIGS. 1, 2, 3, 5, 6 and 7. Rods 34 are rigidly connected to a wall supporting plate 31 so as to extend horizontally outwardly from wall engaging plate 31 which includes wall fastening screws 32. Fiber elements 40 are received in grooves which are similar to groove 14 and operate within grooves provided in rods 34 essentially the same as brushes 12 function in groove 14 in FIGS. 3, 6 and 7 except for the fact that rods 34 are cylindrical and serve a dual purpose as indicated above. Although shown as cylindrical in FIG. 5, the rods may be of another cross-sectional configuration such as, for example, a "D" (or reverse "D") configuration or have a rectangular cross-section similar to rods 10 and 11 in FIGS. 1 through 7, or have triangular, oval or trapezoidal cross-sections.

Figure 10:
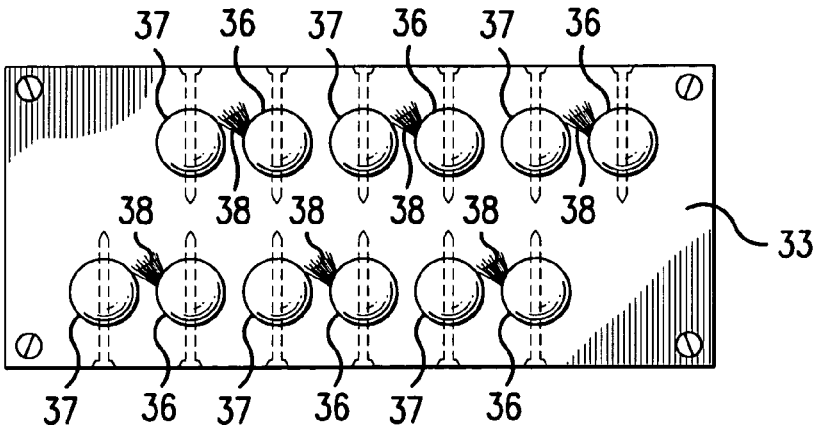
FIG. 10 illustrates a plate for mounting a plurality of hangers in accordance with the invention in a closet or the like wherein the garments are hung side-by-side, but at alternating heights above the floor.

FIG. 10 is an embodiment similar to that shown in FIGS. 8 and 9, wherein a pair of rods 36 and 37 comprising cylindrical brush holding rods and cylindrical passive rods respectively, are rigidly secured in the same manner as shown in FIG. 9 to a wall plate 33 in two horizontal rows, one row above the other, wherein brushes 38 which are substantially the same as brushes 12 and 40 described above and extend from grooves in rods 36 in the same manner as brushes 12 extend from groove 14 and are staggered so that garments in the upper row will hang between garments in the lower row.

Figure 11:
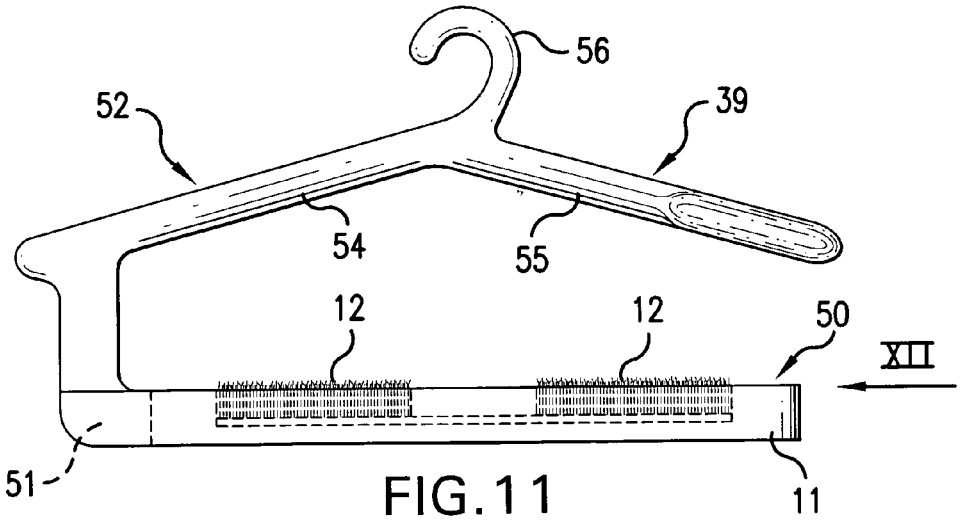
Figure 12:
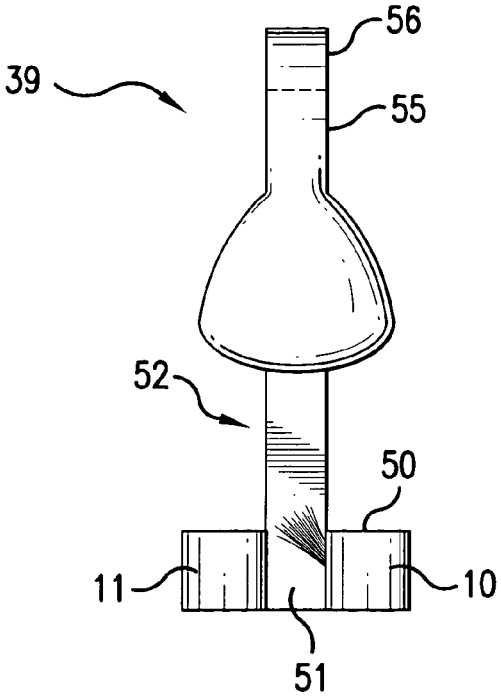
FIG. 12 is a front elevational view of the embodiment shown in FIG. 11 as seen from the direction of arrow XII therein.

FIGS. 11 and 12 disclose a hanger 39 wherein the fork 50 is the same as fork 19 disclosed in FIGS. 1 through 7 except that wall engaging member 20, plastic nut 21, buffer cap 22 and angle piece 23 have been optionally omitted. The width of the slot of fork 50 is defined by a lower portion 51 of a hanger member 52 so that its brush holding and passive rods 10 and 11, respectively, are retained in a horizontal spaced apart disposition as shown in FIGS. 1 through 7. Hanger member 52 comprises oppositely inclined portions 54 and 55 which are joined centrally to form a hook portion 56. The outboard end of inclined portion 55 is spaced above the outboard portion of fork 50 so that garments may be easily inserted into and removed from fork 50. The advantage of the embodiment depicted in FIGS. 11 and 12 is that a user of hanger 39 may, if desired, hang a coat over matching trousers or a woman's suit coat over a matching skirt or slacks.

Figure 13:
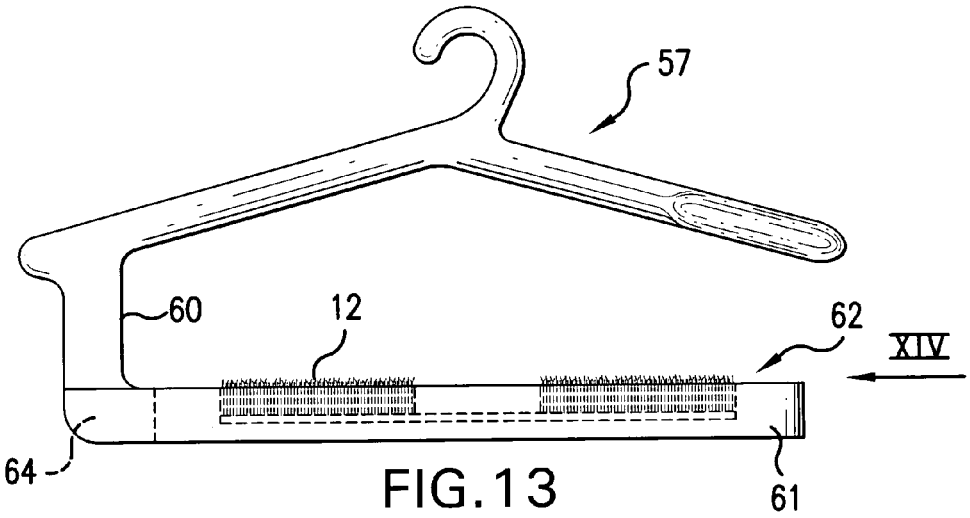
FIG. 13 is similar to FIG. 11 which illustrates a variation thereof.
Figure 14:
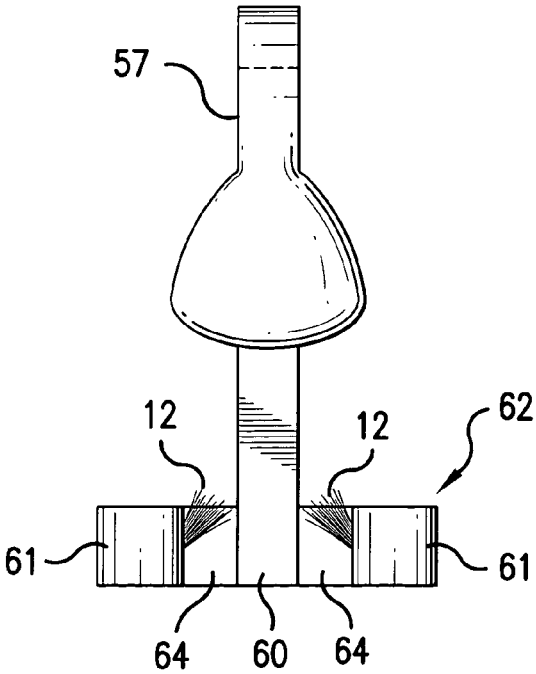
FIG. 14 is similar to FIG. 12, illustrating a variation shown in FIG. 13 as seen from the direction of arrow XIV in FIG. 13.

FIGS. 13 and 14 show a modified hanger similar to that shown in FIGS. 11 and 12 except that it has two sets of brushes 12 which are received against a control passive rod 60 which may be of oval cross-section or at least rounded at their upper edges. In this case rod 60 is an elongation and integral with hanger 57 to form, together with spacers 64, a double fork 62. It will be noted that brush holder rod 60 has two brushes extending from two slots, one slot on each side, from rods 61 which are the same as slot 14 shown in FIGS. 1 through 7. Spacers 64 form a closed ends of the two slots between rods 61 and 60, such slots each having generally the same configuration as slot 13 in FIGS. 1 through 7. Accordingly, except for the limited movement of brushes 12 as previously described, hanger member 57 including the double fork defined by rods 60 and 61 is of an integral one piece construction which may be, as previously indicated for the garment receiving hanger 18, composed of wood, plastic or metal or any suitable equivalent or combination thereof. The advantage of hanger 57 is that it can receive both trousers of a two trouser suit or slacks on one side and a skirt on the other side together with a coat of a woman's suit. Incidentally it will be noted that if brushes 12 are eliminated, hanger 57 could be utilized to receive a man's suit having two trousers which are folded in the usual manner. However, with or without the brushes, hanger 57 provides an advantage that the trousers can be received on the hanger from the side no matter how they are hung and the same is true with respect to the hanger shown in FIGS. 11 and 12. In other words, it is not necessary to remove the hangers shown in FIGS. 11 through 14 for receiving or removing garments.

Figure 15:
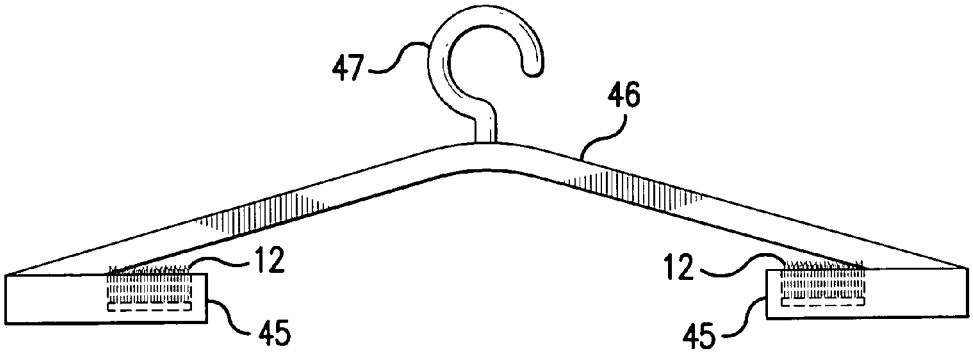
FIG. 15 illustrates a hanger in accordance with the invention having horizontal holding elements which are spaced apart near the outboard ends of the hanger to permit the hanging of garments from their outer edges.

FIG. 15 shows a hanger which includes hanger shoulder means 46 and hook means 47. The hanger shoulder means rigidly supports two short horizontal forks comprising brush and holder rods 45 which function essentially in the same manner as rods 10 and 11 shown in FIGS. 1 through 7 except that the garment is mounted in the slots of both bars 45 on each side of the garment and, as seen, the rods and slots are shorter. The row or rows of fibers 12, as such, may be slightly inclined downwardly in outboard directions and also the individual fibers may be biased somewhat outwardly so that, due to the intervening weight of the garment, they tend to retain garments which they grip more securely in place in each holder rod 45 than if not so inclined or biased or both. The embodiment of FIG. 15 is intended particularly for women's slacks, skirts, to be used instead of conventional hangers which have clamps that are difficult to operate and practically impossible to do so by women who suffer from disabilities such as arthritis to the hands, fingers and wrists.

Figure 16:
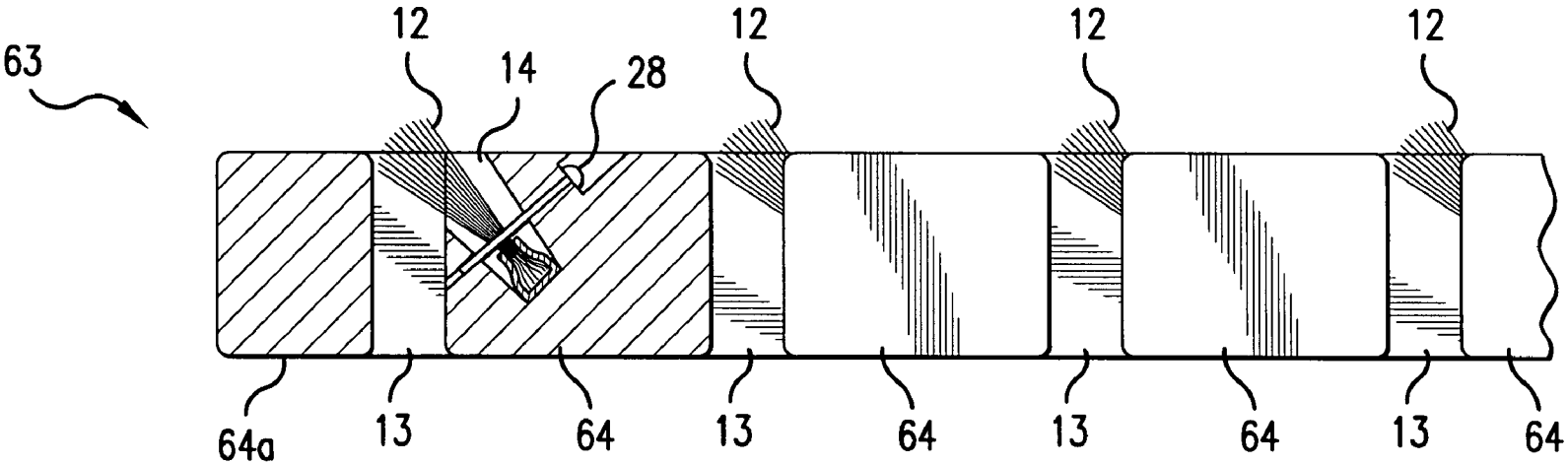
FIG. 16 is partial sectional view of an array of combined brush holder support bars and passive support bars similar to those shown in FIGS. 8 and 9.
Figure 17:
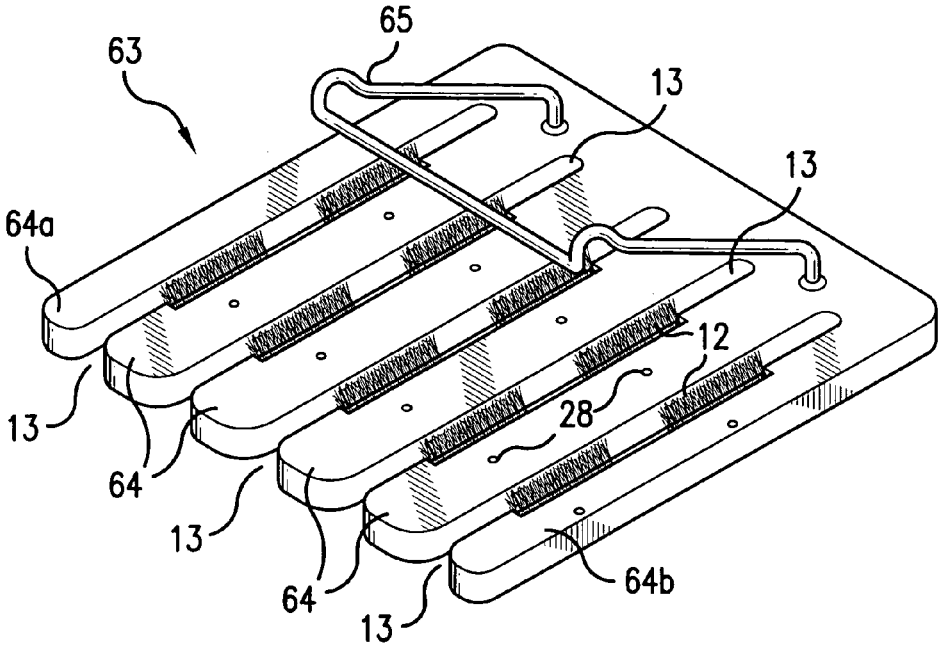
FIG. 17 is an isometric view of a hanger having a plurality of combined bars as shown in FIG. 16.

FIGS. 16 and 17 discloses an array 63 of rods 64 wherein except for the outer rods 64*a* and 64*b*, the rods have on one side the passive vertical areas and on the other side slots 14 carry brushes 12 held in place by pins 28 whereby brushes 12 can move arcuately within limits and bear against the passive vertical sides of rods 64. If desired, here as well as in prior embodiments the vertical passive sides of rods 11 and 64 may be provided with a plurality of small horizontal grooves opposite brushes 12 to enhance the holding power of garments received in slots 13 relative to the downward pull of gravity. As shown in FIG. 17, array 63 is integral except for, of course, brushes 12 and pins 28, and a relatively stiff formed steel wire supporting member 65 is secured to the inner portions of array 63 which is formed to receive a hanger rod over its center of gravity. This is of particular interest because, it will be appreciated, garments received in slots 13 of array 63 will almost always be placed there by a sidewise horizontal movement of the garment and removed in the same manner inasmuch as it may be awkward to remove the entire array 63 from a closet rod for this purpose. The presence of garments in slots other than that wherein a garment is being placed or removed tends to stabilize the array as a whole. This is further indicative of an advantage of the invention in that the hangers, per se, need not be removed or otherwise unduly manipulated for the purpose of receiving garments thereon or removing them therefrom.

Figure 18:
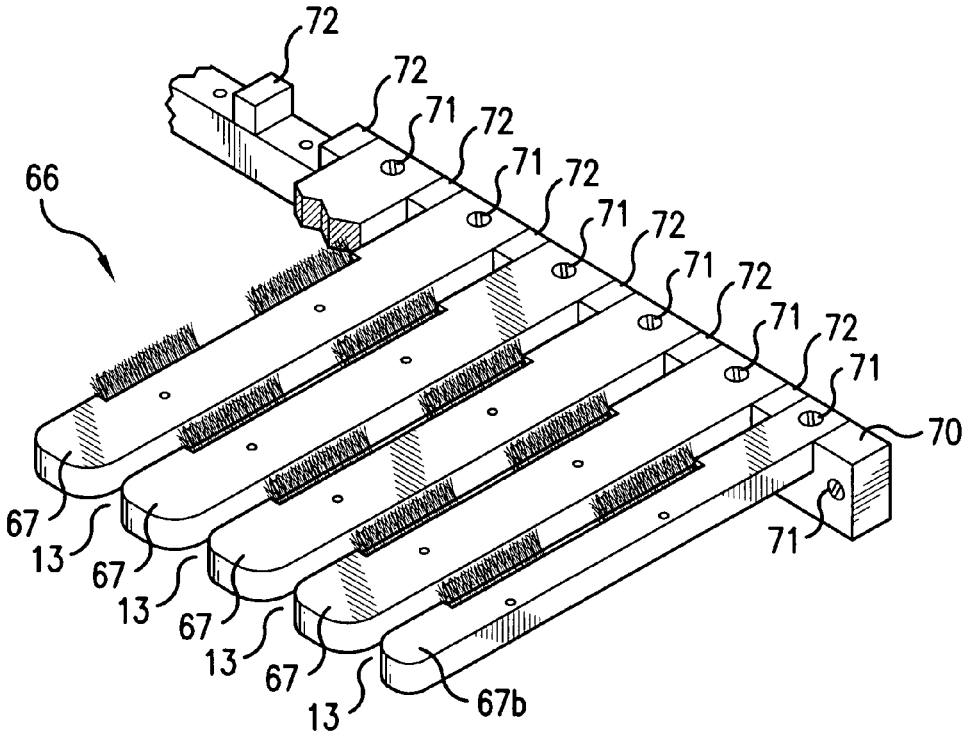
FIG. 18 is a further isometric view similar to FIG. 17 which shows an array of combined bars for direct connection to a wall or other vertical surface.

A variation of the array construction as shown in FIGS. 16 and 17 is illustrated in FIG. 18 wherein array 66 comprises a plurality of rods 67 and 67*b* which are individually secured to a horizontal board 70 that is firmly secured to closet wall by fasteners such as screws 71. Further fasteners 71 secure the individual rods 67 and 67*b* to board 70. Spacers 72 to define the width of slots 13 are secured to board 70 as illustrated by being glued thereto or any other appropriate means as would occur to one skilled in the art.

Figure 19:
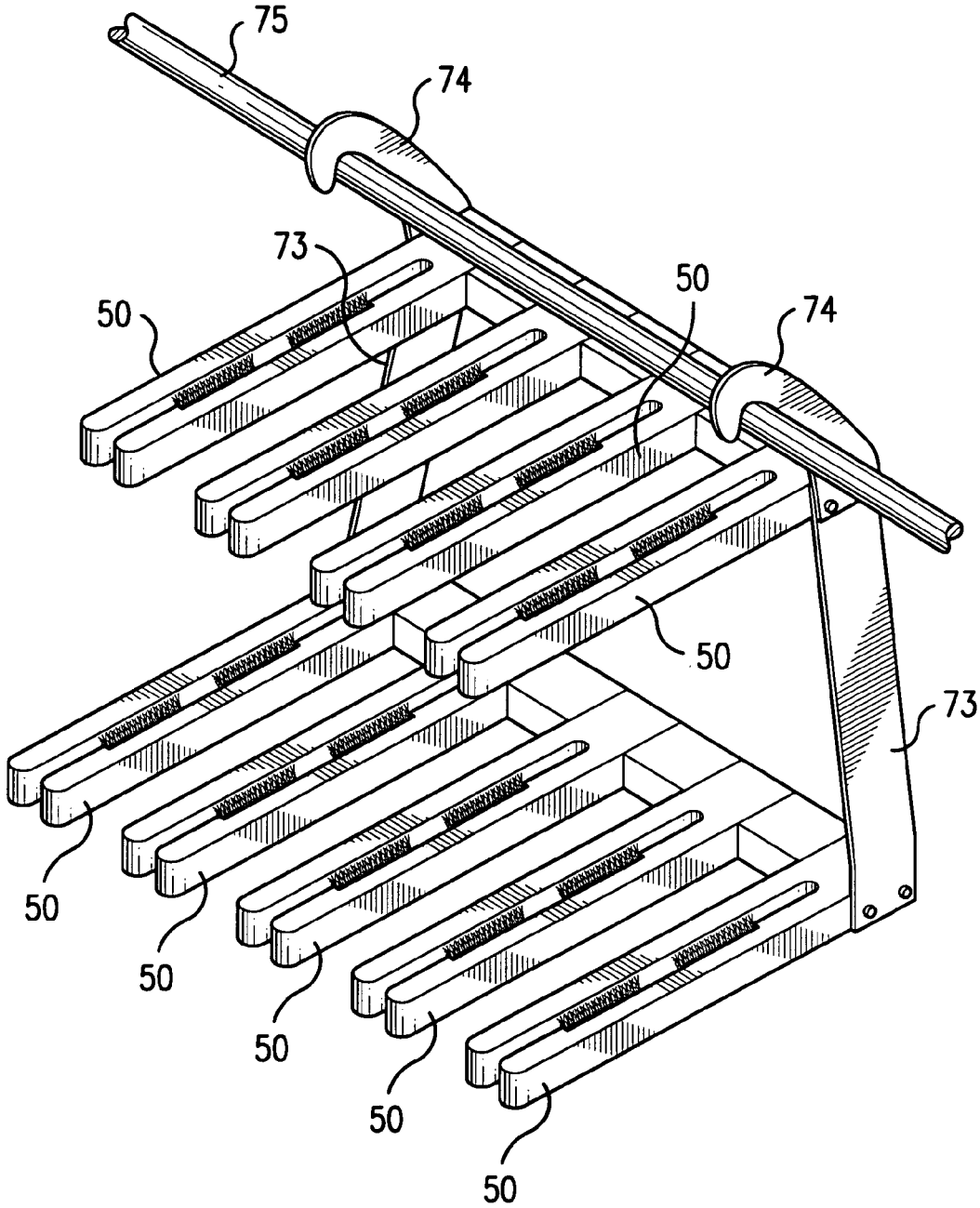
FIG. 19 is an isometric view of a hanger for supporting hanger forks in accordance with the invention wherein the forks are arranged on two levels and staggered so that trousers or the like hanging from forks at the upper level are disposed between hanger forks of the lower level.

Two arrays of forks are depicted in FIG. 19 which are individually similar to forks 50 in FIGS. 11 and 12 are disposed in an arrangement similar to that of FIG. 10 in two rows so that garments placed therein in the upper row will hang between the garments placed in the forks of the lower row. The rows or tiers are twelve inches apart and forks 50 are separated on 4⅛ inch centers. The two tiers are connected by bars 73 so as to be disposed in the staggered manner described above. Each bar 73 includes or has rigidly connected thereto a hook member 74 which is received by a closet bar 75. As with the arrays disclosed in FIGS. 16, 17 and 18, the staggered arrays shown in FIG. 19 are practicable due to the circumstance that garments can be inserted and removed from the forks 50 in horizontal sidewise movements using one hand only. This is impractical with most conventional hangers used today.

Figure 20:
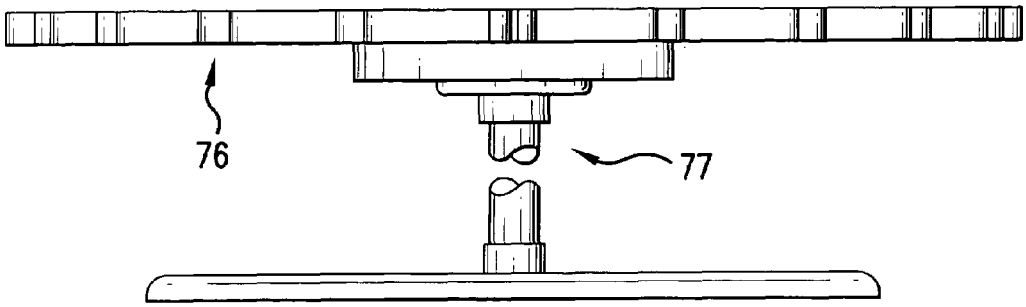
FIG. 20 is a partially broken side elevational view of a plurality of hanger forks in accordance with the invention which are arranged to extend radially from a central axis.
Figure 21:
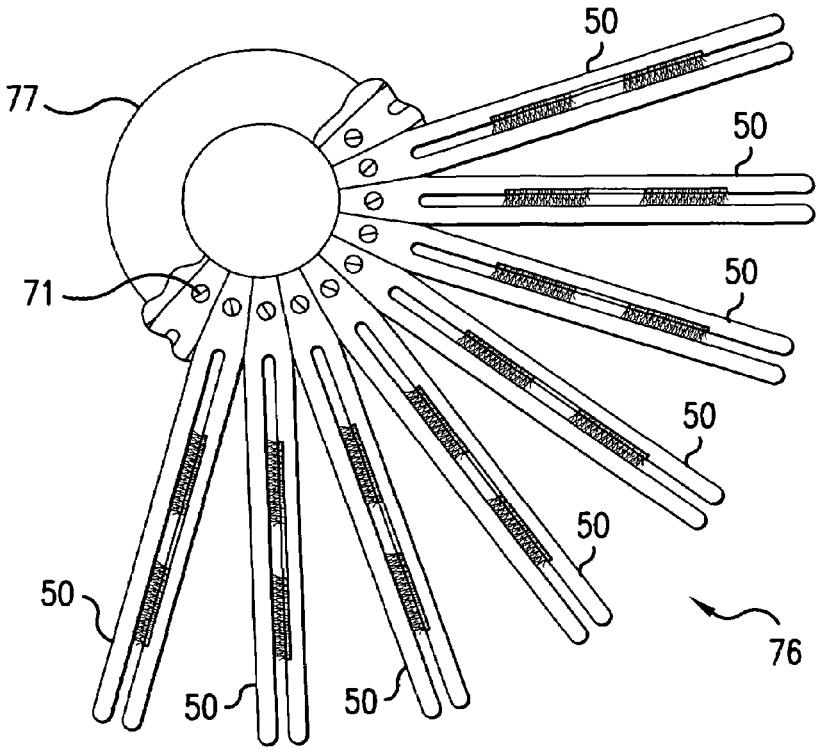
FIG. 21 is a top plan view of the hanger forks arranged in a circle as shown in FIG. 20.

FIGS. 20 and 21 disclose the invention being used in a circular array 76 of individual forks 50 which are similar to forks 19 and 50 except that their inboard ends are received by a rotatable stand 77. It will be noted that the inboard parts of these forks 50 are beveled inwardly and secured to stand 77 by fasteners 71. It is intended that circular arrays 76 will be used primarily in department and clothing stores whereby a variety of garments can be received by forks 50 which can be easily removed and returned without the necessity of removing the hangers at the same time and by a person who is standing at one place and turning the array to the garments he or she wishes to inspect for possible purchase. Of course the array as disclosed in FIGS. 16 and 17 can have other uses for hanging a variety of items including clothing which may be required at work or for sanitation purposes. Also two arrays 76 may be provided, one staggered relative to the other as shown in FIGS. 10 and 19 and rotatable therewith.

Figure 22:
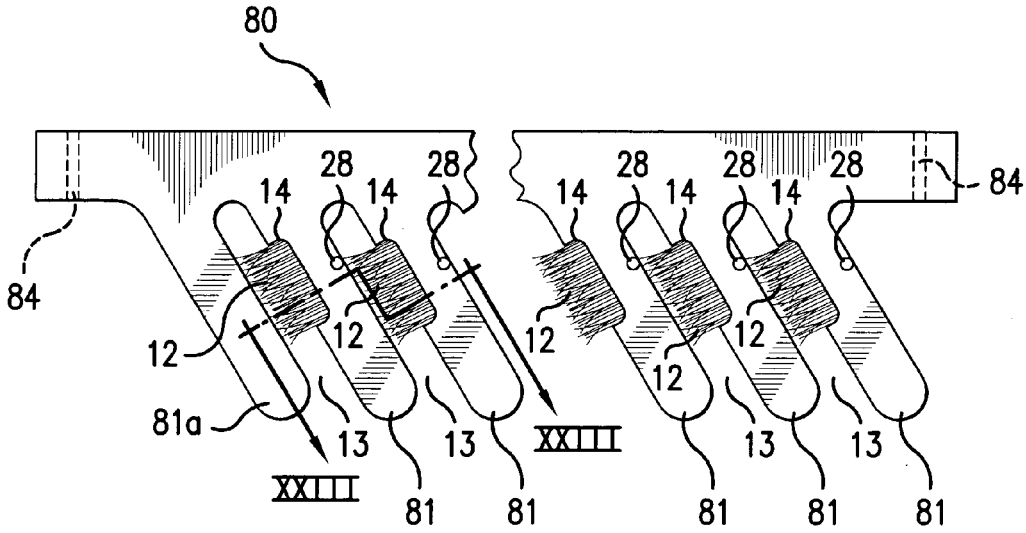
FIG. 22 is a top plan broken view of an array of hanger forks in accordance with the invention intended for ties, kitchen towels, belts and the like wherein the hanger forks extend at a bias from a member intended for engaging a wall or other vertical surface.
Figure 23:
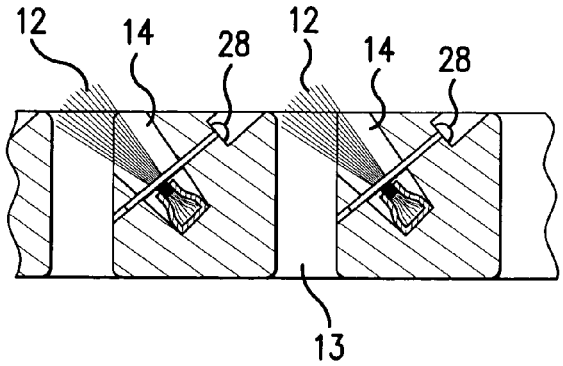
FIG. 23 is a partial cross-sectional view taken on section lines XXII—XXII of FIG. 22.
Figure 24:
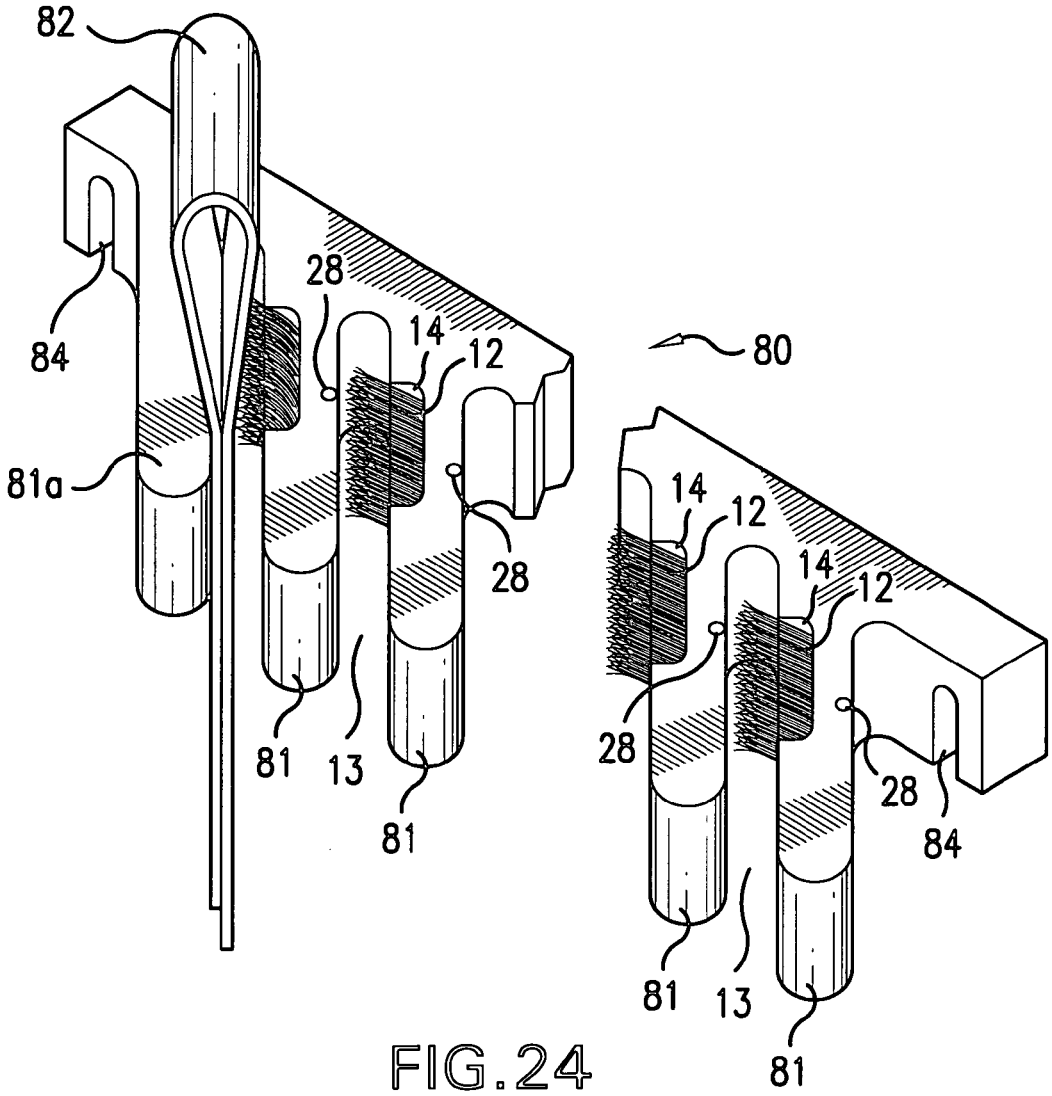
FIG. 24 is a partially broken isometric view of the array of hanger forks shown in FIGS. 22 and 23.

An array for smaller items is shown in FIGS. 22, 23 and 24 wherein the array is similar to those shown in FIGS. 16, 17 and 18, particular FIG. 18, except that it is molded or formed from a material such as wood or plastic to be integral. The array 80 as shown in FIGS. 22, 23 and 24 comprises biased rods 81 and 81*a* each of which contains a set of brushes 12 extending and received from slots 14 and secured in place by pins 28, all as previously described herein. Slots 13 in this embodiment are intended to receive items such as ties 82 or towels or washcloths or any other item which can be supported in this manner. Slots 84 are provided so that arrays can be placed on hooks or other fasteners such as in a closet or on the interior of a closet door or, for washcloths and the like, in a kitchen.

Figure 25:
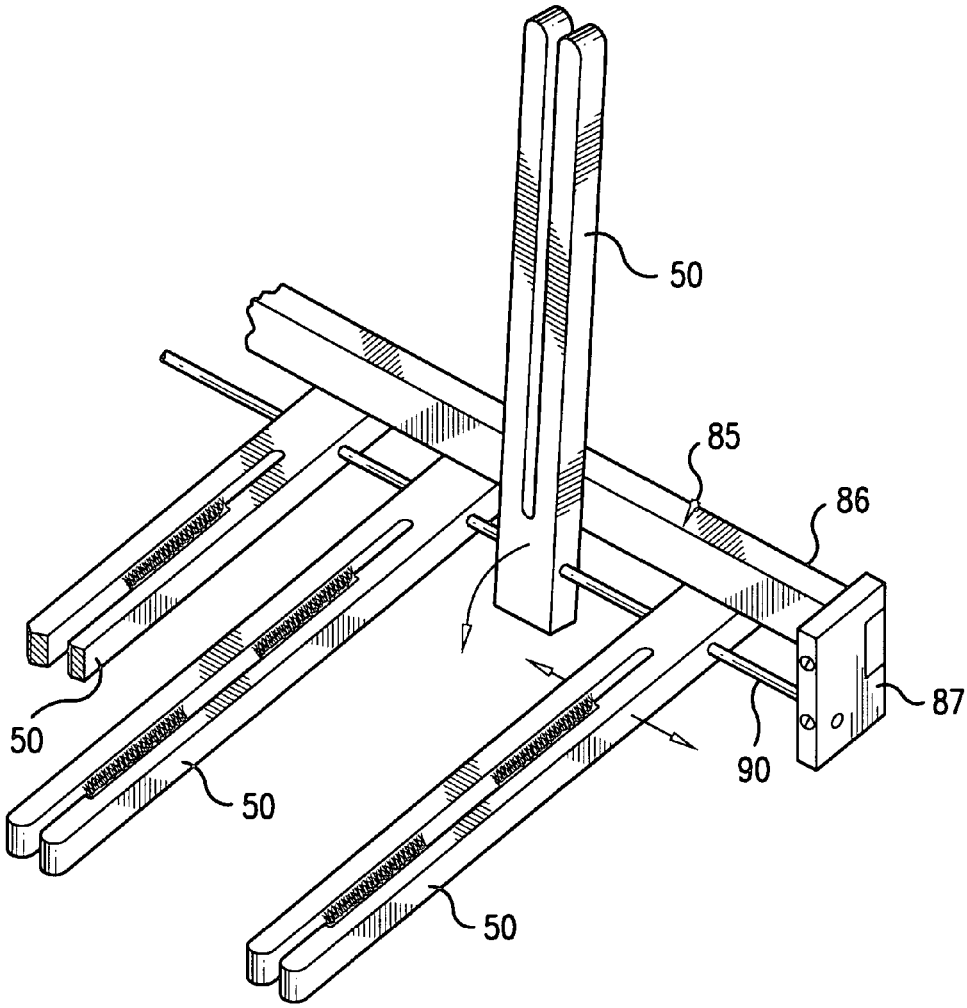
FIG. 25 is a broken isometric view showing a fork in accordance with the invention slidably supported so as to be pivotable about a rod which may be mounted on a vertical surface.

FIG. 25 discloses a support assembly 85 which comprises a horizontal rod 86 which is connected to a vertical plate 87 which, in turn, receives a horizontal member comprising a rod 90 which has a circular cross-section and is disposed parallel to and below rod 86. Each fork 50 has in its after portion a bore which receives rod 90 whereby each fork 50 can be moved from a horizontal to a vertical position relative to the axis of rod 90 and also may be slid horizontally along rod 90 to adjust its transverse position. The outermost after end of each fork 50 contacts the bottom of rod 86 to retain fork 50 in its normal functioning position.

Figure 26:
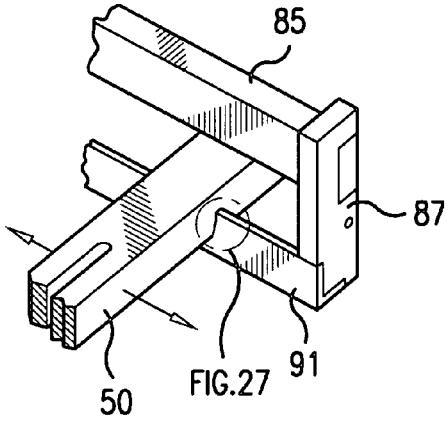
Figure 27:
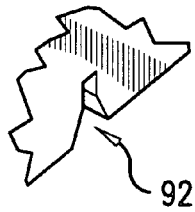
FIG. 27 is a detailed view of the notch onto which the fork of FIG. 26 is received.

In FIGS. 26 and 27, a variation of the arrangement of FIG. 25 is disclosed wherein instead of rod 90, an angle rod 91 is secured to vertical plate 87 which is received in a notch 92 in the bottom of fork 50 in a cantilever fashion as shown in FIG. 27 which permits fork 50 to be moved upwardly in an arcuate movement relative to rod 91 within limits and also to be entirely removed relative to rod 91. Rod 85 engages the aftermost portion of fork 50 as seen in FIG. 26 when fork 50 is in a functioning position to receive clothing or other articles. As with the arrangement shown in FIG. 25, fork 50 can be slid in a transverse manner or otherwise relocated transversely relative to rod 91. The arrangement shown in FIGS. 26 and 27 is advantageous in that the forks can be arranged to accommodate clothing or other articles which hang from them and also, when desired, can be easily removed for cleaning or repair. Also forks 50 can be added or removed or replaced, if desired, with further forks of different designs. In addition, if desired, inclined portions such as shown in FIGS. 11–14 without the need of hooks could, without undue difficulty, as will be appreciated by those skilled in the art, added to the forks 50 as shown in FIGS. 25, 26 and 27, particularly FIGS. 26 and 27, whereby hangers capable of receiving coats or dresses could be supported via such additions to forks 50 in such figures without the need of having hangers with hooks therefor. Such arrangements allows clothes to be hung at higher levels relative to the supports for the hangers than is possible with hangers having hooks received on rods or poles.

The invention has other uses. Essentially it is a hanger and thus may be employed for hanging other items such as prints while ink or other material thereon is in the process of drying or being cured or dehydrated or the like.

Although I have disclosed the preferred embodiments of my invention, it is to be understood that it is capable of other adaptations and modifications within the scope of the following claims:

The invention claimed is:

1. A mechanism for removably hanging articles which comprises a pair of substantially horizontally disposed rods which define between them a slot for removably receiving an article for being hung from the mechanism, a plurality of elements comprising upwardly inclined fibers which are supported by at least one of said rods and which are deflectable in reaction to said article being inserted and removed into and from said slot while imparting minimal frictional resistance to the relative horizontal movement between said rods and said article, said elements bearing sufficiently against said article while in said slot frictionally to prevent said article from falling from said slot due to gravity.

2. A mechanism in accordance with claim 1, wherein said article comprises a garment.

3. A mechanism in accordance with claim 2, wherein said garment consists of trousers, slacks, pants or a skirt.

4. A mechanism in accordance with claim 1 in combination with a plurality of further like mechanisms, said plurality of further like mechanisms and the first mentioned mechanism being mounted side-by-side on supporting means therefor.

5. A combination of mechanisms in accordance with claim 4, which comprises two rows of said mechanisms, said slots of said mechanisms alternating relative to each other as seen from above.

6. A mechanism in accordance with claim 1 wherein said elements comprise brush fibers.

7. A mechanism in accordance with claim 2 comprising hook means for hanging the mechanism from a horizontally disposed pole.

8. A mechanism in accordance with claim 7 comprising shoulder means for receiving a further garment, said shoulder means interconnecting at least one of said rods and said hook means.

9. A mechanism in accordance with claim 8, which comprises a further pair of said rods which define a further slot that is aligned with said first mentioned slot, a further plurality of said elements carried by at least one of said further pair of rods in said further slot for receiving and removably retaining a said garment therein.

10. A mechanism in accordance with claim 1, wherein said elements are flexible.

11. A mechanism in accordance with claim 1, wherein said elements are resilient.

12. A mechanism in accordance with claim 1, wherein said elements comprise fibrils.

13. A mechanism in accordance with claim 1, wherein said elements comprise resilient wires.

14. A mechanism in accordance with claim 1, wherein said elements comprise cam-like members.

15. A mechanism in accordance with claim 1, wherein a plurality of said rods are supported on a rotatable stand and extend substantially radially from a vertical axis of rotation of said stand.

16. A hanger comprising two parallel substantially horizontal bars which define a slot between them and a plurality of fibers extending outwardly from one of said bars towards the other of said bars, said plurality of fibers being inclined upwardly from said one bar to proximate the other said bar whereby items can be moved horizontally into and out of said slot and supported therein by said plurality of fibers.

17. A hanger in accordance with claim 16, wherein said fibers are bent downwardly by the force of gravity on an item which is being supported in said slot by said plurality of fibers.

18. A hanger in accordance with claim 16, wherein said plurality of fibers are arcuately supported from said one bar whereby said plurality of fibers is pivotable in said slot in an arc of about thirty degrees.

19. A hanger in accordance with claim 16, wherein said plurality of fibers are arcuately supported from said one bar so as to be moveable relative to the horizontal in an arc of between about forty and seventy degrees.

20. A hanger comprising an array of parallel substantially horizontal bars which define between them slots, a plurality of fibers extending outwardly from said bars into said slots, each said plurality of fibers being inclined upwardly from the bar from which it extends across each of said slots whereby items can be moved horizontally into and out of each of said slots and supported therein by a corresponding plurality of fibers extending across the respective slots.

21. An array of hangers in accordance with claim 20, wherein each of said bars extends perpendicular to a base to which each of said bars is connected.

22. An array of hangers in accordance with claim 20, wherein each of said bars extends from a base to which each of said bars is connected at a bias.

23. An array of hangers in accordance with claim 20, wherein each said hanger is supported on its inboard end by a horizontal member which extends normally relative to the hanger.

24. An array of hangers in accordance with claim 23, wherein each said hanger is rotatably relative to said horizontal member.

25. An array of hangers in accordance with claim 22, wherein in each said hanger is removably mounted from said horizontal member in a cantilever fashion.

* * * * *